US007463197B2

(12) United States Patent
Rafi et al.

(10) Patent No.: US 7,463,197 B2
(45) Date of Patent: Dec. 9, 2008

(54) MULTI-BAND ANTENNA

(75) Inventors: Gholamreza Zeinolabedin Rafi, Kitchener (CA); Safieddin Safavi-Naeini, Waterloo (CA); Sujeet K. Chaudhuri, Heidelberg (CA); Wai-Cheung Tang, Mannhein (CA)

(73) Assignee: Mark IV Industries Corp., Ontario (CA)

( * ) Notice: Subject to any disclaimer, the term of this patent is extended or adjusted under 35 U.S.C. 154(b) by 193 days.

(21) Appl. No.: 11/252,162

(22) Filed: Oct. 17, 2005

(65) Prior Publication Data

US 2007/0085741 A1 Apr. 19, 2007

(51) Int. Cl.
*H01Q 1/38* (2006.01)

(52) U.S. Cl. ..... 343/700 MS

(58) Field of Classification Search ..... 343/700 MS, 343/767, 770

See application file for complete search history.

(56) References Cited

U.S. PATENT DOCUMENTS 5,003,318 A * 3/1991 Berneking et al. .... 343/700 MS
6,448,932 B1 9/2002 Stoiljkovic et al.
6,507,321 B2 1/2003 Oberschmidt et al.
6,710,748 B2 * 3/2004 Yarasi et al. ..... 343/702
2002/0171592 A1 11/2002 Mikkola et al.
2003/0063031 A1 4/2003 Wong et al.

OTHER PUBLICATIONS

Rafi and Shafai "Broadband Microstrip Patch Antenna with V-Slot", IEE Proc.-Microw. Antennas Propag., vol. 151, No. 5, Oct. 2004, 435.

Itoh, "High Efficiency Microwave Transmitter Front-End", Final Report 1998-1999 for MICRO Project 98-063.

* cited by examiner

*Primary Examiner*—Michael C Wimer
(74) *Attorney, Agent, or Firm*—Eugene M. Cummings, P.C.

(57) ABSTRACT

A multi-band antenna for multi-band radio frequency telecommunications. The multi-band antenna includes a conductive patch separated from a ground plane by a dielectric material. A slot pattern formed in the conductive patch defines a perimeter substantially surrounding two feed pins and arranged symmetrically about a center line. The slot pattern includes one or more inwardly extending arms projected along axes that pass between the two feed pins. The axes may be parallel to the center line. The slot pattern may be arranged using folded slots. In one embodiment, circular polarization is realized at GPS frequency by using one feed pin and linear or circular polarization is realized by using one or two feed pins for other bands. The feed pins may be controlled independently without a fixed phase and amplitude arrangement necessary to achieve a fixed polarization (linear, circular, or elliptical), which allows for adaptive pattern and polarization agility.

20 Claims, 9 Drawing Sheets

Antenna pattern and axial ratio at 1.5 GHz

Antenna pattern and axial ratio at 1.95 GHz

Antenna pattern and axial ratio at 2.45 GHz

Antenna pattern and axial ratio at 5.8 GHz

MULTI-BAND ANTENNA

FIELD OF THE INVENTION

The present invention relates to patch antennas and, in particular, to a multi-band antenna.

BACKGROUND OF THE INVENTION

The proliferation of radio-frequency based technology, such as cellular telephones, RFID devices, and other wireless devices, has led to a number of developments in antenna design. One popular antenna type is the patch antenna, whereby a radiating patch is positioned parallel to and spaced apart from a ground plane. A dielectric substance is placed between the patch and the ground plane. Signals may be provided to the patch, and incoming signals may be obtained, through a coaxial feed extending through the dielectric material and connected to the patch.

At present, standards have been developed that apply to communication in a number of different frequency bands, sometime for different purposes or applications. Example standards include GPS, GPRS, 2.4 GHz WLAN, 5.8 GHz WLAN, and the new 5.9 GHz DSRC bands.

There are existing antennae that attempt to operate in multiple bands; however, multi-band operation in existing antennae is typically restricted to harmonics.

It would be advantageous to provide an improved antenna that enables multi-band operation.

SUMMARY OF THE INVENTION

The present invention provides a multi-band antenna for multi-band radio frequency telecommunications. The multi-band antenna includes a conductive patch separated from a ground plane by a dielectric material. A slot pattern formed in the conductive patch defines a perimeter substantially surrounding two feed pins and arranged symmetrically about a center line. The slot pattern includes one or more inwardly extending arms projected along axes that pass between the two feed pins. The axes may be parallel to the center line. The slot pattern may be arranged using folded slots. In one embodiment, circular polarization is realized at GPS frequency by using one feed and linear or circular polarization is realized by using one or two feeds for other bands. The feed pins may be controlled independently without a fixed phase and amplitude arrangement necessary to achieve a fixed polarization (linear, circular, or elliptical), which allows for adaptive pattern and polarization agility.

In one aspect, the present invention provides a multi-band antenna. The antenna includes a planar conductive patch, a ground plane parallel to and spaced apart from the planar conductive patch, and a dielectric substrate disposed between the planar conductive patch and the ground plane. It also includes at least two feed pins connected to the planar conductive patch through the dielectric substrate. The planar conductive patch includes a slot pattern. The slot pattern defines a perimeter substantially surrounding the at least two feed pins. The slot pattern is symmetrical about a center axis.

In another aspect, the present invention provides a multi-band antenna. The antenna includes a planar conductive patch, a ground plane parallel to and spaced apart from the planar conductive patch, and a dielectric substrate disposed between the planar conductive patch and the ground plane. The antenna also includes two feed pins connected to the planar conductive patch through the dielectric substrate. The planar conductive patch defines at least two folded slots. The folded slots each include at least three straight segments joined at angles. The folded slots are arranged to define a perimeter substantially surrounding the at least two feed pins and are disposed symmetrically about a center axis passing between the two feed pins. At least one of the folded slots includes an inwardly extending arm projecting inwards from the perimeter.

In yet another aspect, the present invention provides a multi-band antenna including a planar conductive patch, a ground plane parallel to and spaced apart from the planar conductive patch, and a dielectric substrate disposed between the planar conductive patch and the ground plane. The antenna also includes at least one feed pin connected to the planar conductive patch through the dielectric substrate. The planar conductive patch includes a slot pattern. The slot pattern defines a perimeter substantially surrounding the at least one feed pin. The slot pattern is symmetrical about a center axis, and it includes an inwardly extending arm projecting inwards from the perimeter.

Other aspects and features of the present invention will be apparent to those of ordinary skill in the art from a review of the following detailed description when considered in conjunction with the drawings.

BRIEF DESCRIPTION OF THE DRAWINGS

Reference will now be made, by way of example, to the accompanying drawings which show an embodiment of the present invention, and in which.

Similar reference numerals are used in different figures to denote similar components.

DESCRIPTION OF SPECIFIC EMBODIMENTS

The description herein refers to a slot pattern wherein two or more slots are arranged to define a perimeter substantially surrounding two feed pins. It will be appreciated that references to "a perimeter substantially surrounding" are intended to convey the fact that the slots arranged along the perimeter are separated by gaps at their ends, i.e. that there are breaks in the surrounding perimeter; the slots making up the perimeter do not form one contiguous slot. In one embodiment, however, it is possible that the perimeter slots may be arranged so as join in one contiguous slot.

The following description makes reference to the radiating element of the antenna being a "conductive" patch. In many embodiments, the patch may be formed from a metal or metal alloy; however, in some embodiments, the patch may be formed from non-metallic electrical conductors such as superconductors. There are also other types of non-metallic electrical conductors that may be used in some specific embodiments. Accordingly, references herein to a "conductive patch" may be understood as including metallic and non-metallic electrical conductors.

Figure 1:
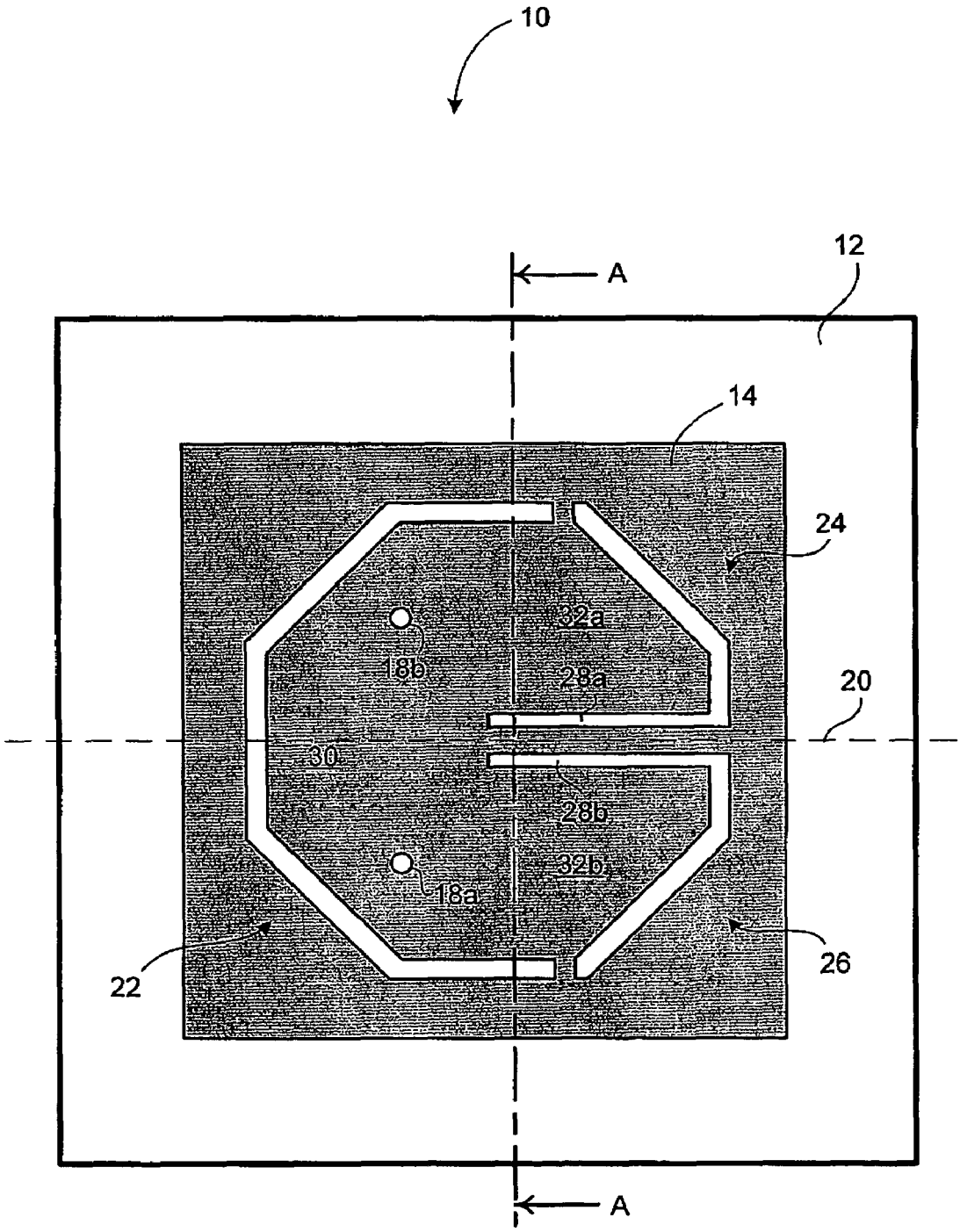
FIG. 1 diagrammatically shows a top plan view an embodiment of a multi-band planar antenna.
Figure 2:
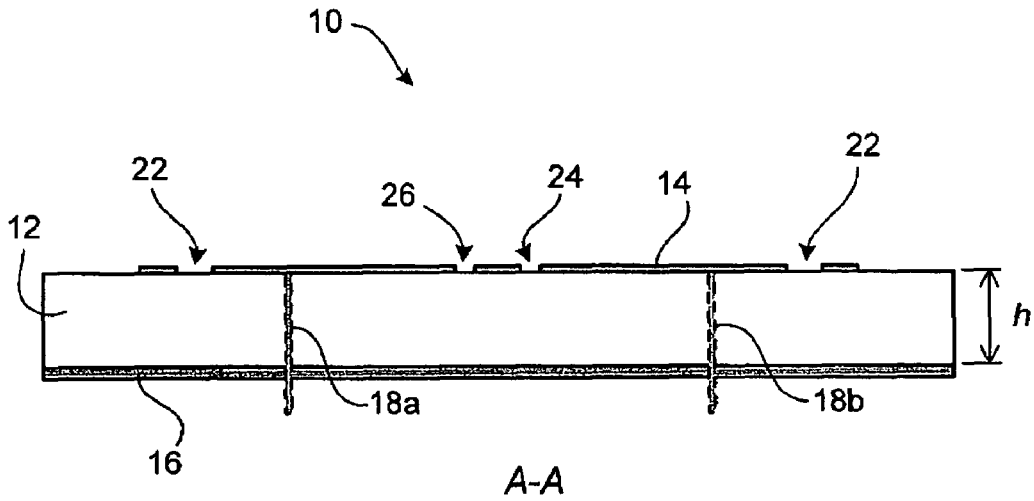
FIG. 2 shows a cross-sectional view of the multi-band planar antenna of FIG. 1 along the axis A-A.

Reference is made to FIGS. 1 and 2. FIG. 1 diagrammatically shows a top plan view an embodiment of a multi-band planar antenna 10. FIG. 2 shows a cross-sectional view of the multi-band planar antenna 10 along the axis A-A.

The antenna 10 includes a ground plane 16 and a planar conductive patch 14. The planar conductive patch 14 is parallel to and spaced apart from the ground plane 16. A dielectric material 12 fills the space between the ground plane 16 and the planar conductive patch 14. The ground plane 16 is larger than the planar conductive patch 14 so as to approximate an infinite ground plane; however, the actual size of the ground plane 16 may be limited by design considerations and physical space limitations. In one embodiment, the planar conductive patch 14 is square; however, it will be appreciated that other shapes may be used in other embodiments.

The antenna 10 includes two feed ports. The feed ports are electrically connected to the planar conductive patch 14 as feed pins 18 (shown individually as 18*a* and 18*b*) extending up through the dielectric material 12. In this embodiment, the feed pins 18 are spaced apart symmetrically about a center axis 20. The center axis 20 bisects the antenna 10. The feed pins 18 supply excitation signals to the antenna 10 from an antenna driver (not shown) or obtain received signals from the antenna 10 and send the received signals to a receiver (not shown).

The planar conductive patch 14 includes apertures that are shaped to define a symmetrical perimeter substantially surrounding the feed pins 18. The perimeter is formed from two or more slots. In some embodiments, the two or more slots are folded slots. The folded slots are arranged symmetrically about the center axis 20. In one embodiment, the folded slots may include U-shaped folded slots. In another embodiment, the folded slots may include V-shaped folded slots. In many embodiments V-shaped slots provide wider bandwidth than similar U-shaped slots: see G. Rafi et al., "Broadband microstrip patch antenna with V-slot", *IEE Proceedings, Microwaves, Antennas and Propagation*, v. 151, Issue 5, October 2004, pp. 435-440. The term "V-shaped" is intended to include "truncated" v-shaped slots, i.e. where three or more straight sections are joined at obtuse angles. The folded slots may be different shapes in other embodiments. The physical placement and dimensions of the folded slots help to define the resonant characteristics of the antenna 10. In some embodiments, the folded slots are arranged to create a perimeter having a polygonal geometry; however, in other embodiments, curved slots may be used to create a perimeter having a non-polygonal geometry.

In the embodiment shown in FIG. 1, the planar conductive patch 14 defines three folded slots: a first slot 22, a second slot 24, and a third slot 26. The three folded slots 22, 24, 26 are arranged symmetrically about the center axis 20. The three slots 22, 24, 26 are configured so as to define a slotted perimeter partially enclosing a central area containing the two feed pins 18.

In one embodiment, the slots 22, 24, 26 are shaped such that they define an octagonal perimeter. The first slot 22 includes five segments which make up five sides of the octagonal perimeter. The first slot 22 is disposed such that it is bisected by the center axis 20. The five segments of the first slot 22 are joined at obtuse angles. The second slot 24 and the third slot 26 include segments that define the remaining three sides of the octagonal perimeter.

The second slot 24 and third slot 26 also each include inwardly extending segments 28*a* and 28*b*, respectively. The inwardly extending segments 28*a* and 28*b* are disposed upon axes that run parallel to the center axis 20 and pass between the two feed pins 18*a* and 18*b*.

The perimeter slots and the inwardly extending segments 28*a* and 28*b* serve to partition the central area into at least three zones: a first zone 30 containing the two feed pins 18 and bounded generally on three sides by the first slot 22, and a second zone 32*a* and third zone 32*b* bounded generally on three sides by the second slot 24 and third slot 26, respectively. The three zones 30, 32*a*, and 32*b*, allow for the development of multiple modes. The first zone 30 tends to facilitate the development of lower frequency wide bandwidth modes. The second and third zones 32 tend to facilitate the development of higher frequency modes.

Adjustments to the length, width, and angles of the various slots 22, 24, 26 tunes the antenna 10 resonance. The location of the feed pins 18 may also be adjusted to fine tune the modes and polarization.

The length, width, and angles may be optimized so as to obtain multi-band performance. In one embodiment, the antenna 10 provides five or more bands, including GPS, GPRS, 2.4 WLAN, 5.8 WLAN, and DSRC 5.9 GHz.

The position of the dual feed pins 18 may then be optimized to realize circular polarization in one or more modes. For example, the dual feed pins 18 may be positioned to obtain circular polarization in the GPS band at approximately 1.5 GHz. Linear polarization is realized with respect to the other modes.

The bandwidth in upper frequency bands may be broadened through appropriate choice of dimensions for the second slot 24 and third slot 26. In one example embodiment, the dimensions of the second slot 24 and third slot 26 are optimized to provide wider bandwidth in the interval 5 GHz to 6 GHz.

Figure 7:
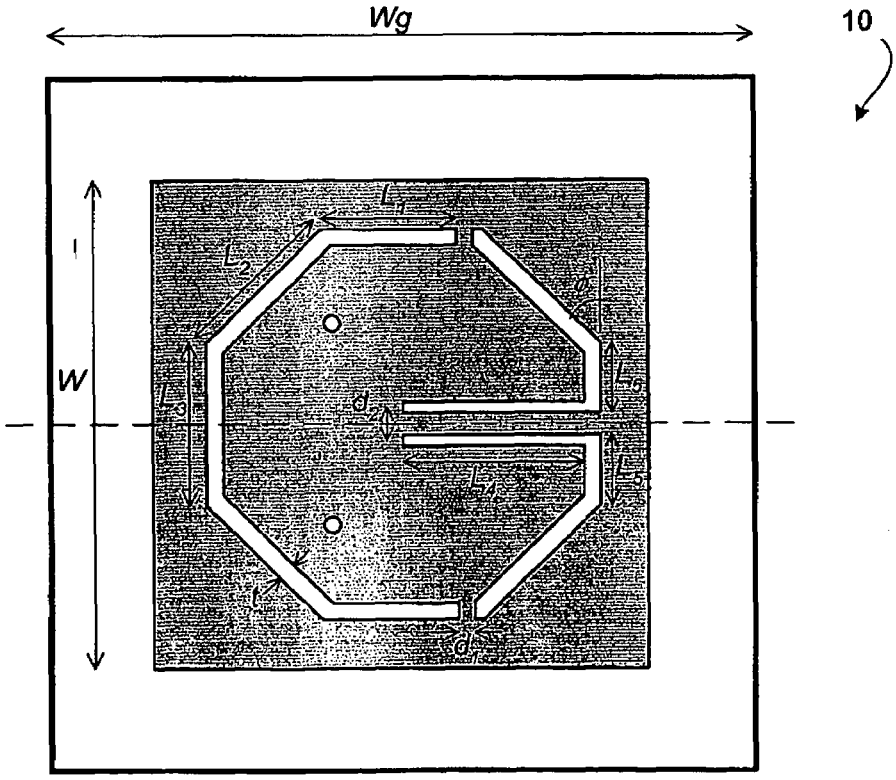
FIG. 7 shows a top plan view of an example embodiment of the multi-band planar antenna of FIG. 1.

Reference is now made to FIG. 7, which shows an embodiment of the antenna 10 of FIG. 1. In this embodiment, the planar conductive patch 14 is a square with a side dimension of W The ground plane 16 is also a square and has a side dimension of Wg. The first slot 22 has a geometry determined by the lengths $L_1$, $L_2$, $L_3$. The second and third slots 24, 26 have a geometry determined by the lengths $L_2$, $L_4$, $L_5$. The angles $\phi$ between segments making up the octagonal perimeter are all approximately 45 degrees.

The width of the slots 22, 24, 25 is of dimension t, and the gap between the ends of the first slot 22 and the ends of the respective second slot 24 and third slot 26 on the perimeter are of dimension $d_1$. The inwardly extending segments 28*a* and 28*b* are separated by a distance $d_2$.

The dielectric material 12 has a dielectric constant of $\in_r$, and a thickness of dimension h (FIG. 2).

In one example embodiment, the dimensions of the antenna 10 are as follows:

W=35 mm

Wg=55 mm $L_1$=12.8 mm $L_2$=12 mm $L_3$=13.7 mm $L_4$=13.7 mm
$L_5$=6.3 mm
$d_1$=1 mm
$d_2$=2 mm
t=1.5 mm
h=3.04 mm
$\epsilon_r$=3.00

With these dimensions, this embodiment of the antenna 10 realizes multiband operation in the GPS, GPRS, WLAN, and DSRC frequency ranges. The location of the dual feed ports may be selected so as to realize circular polarization in the GPS band and to increase bandwidth at the upper frequency bands.

Figure 8:
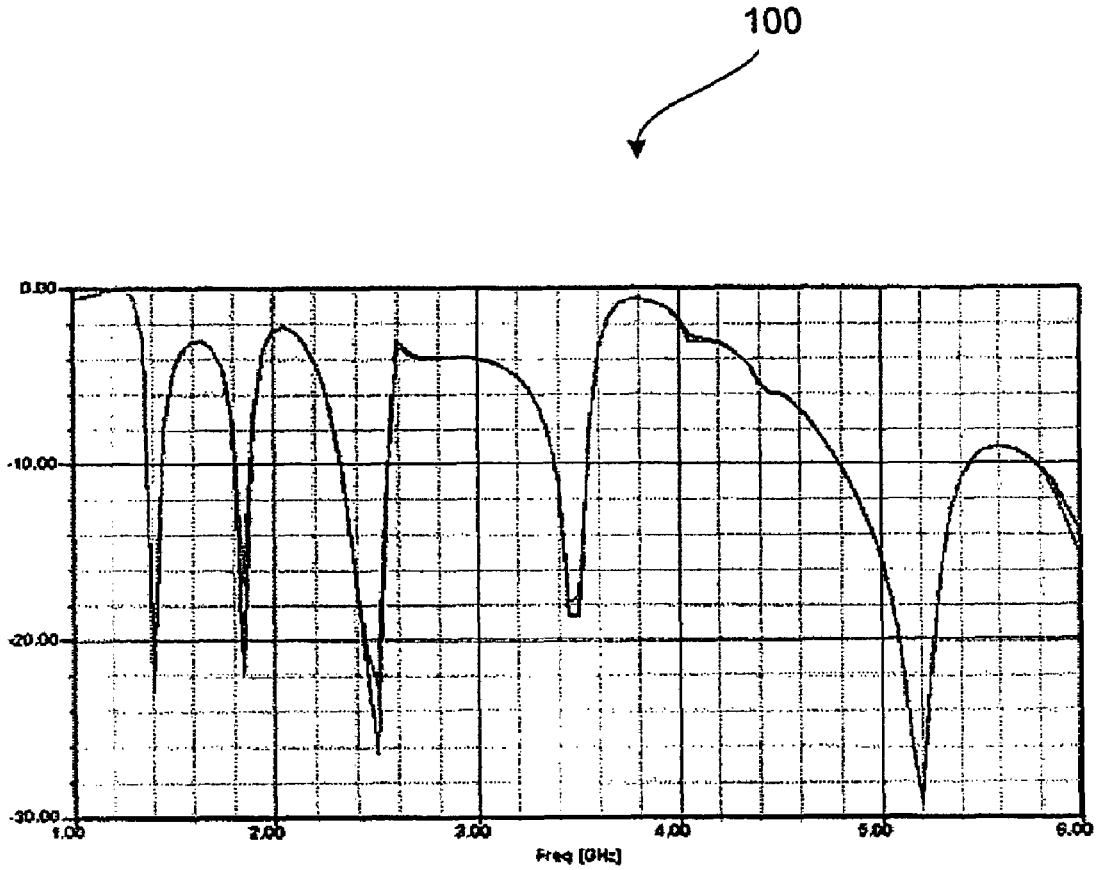
FIG. 8 shows a graph of return loss versus frequency for the example antenna of FIG. 7.
Figure 9A:
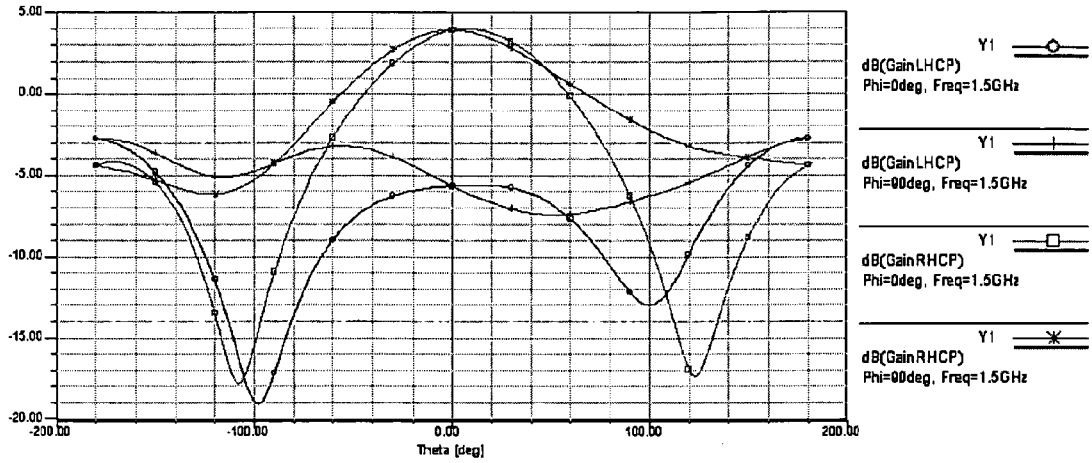
FIGS. 9*a* through 9*d* show graphs of the E-plane and H-plane patterns and cross-polarization of the example embodiment antenna of FIG. 7 at 1.5 GHz, 1.95 GHz, 2.45 GHz, and 5.8-6 GHz, respectively.
Figure 9B:
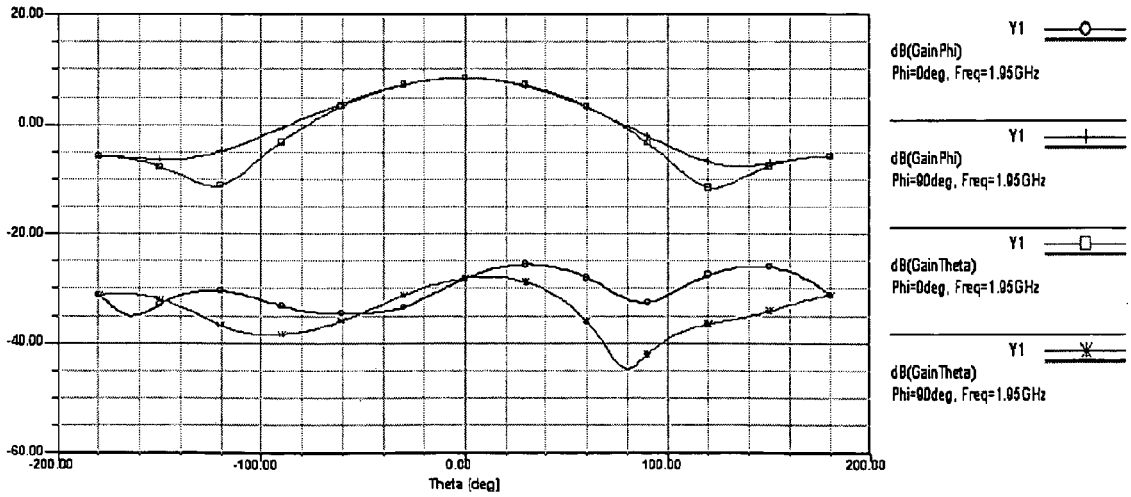
Figure 9C:
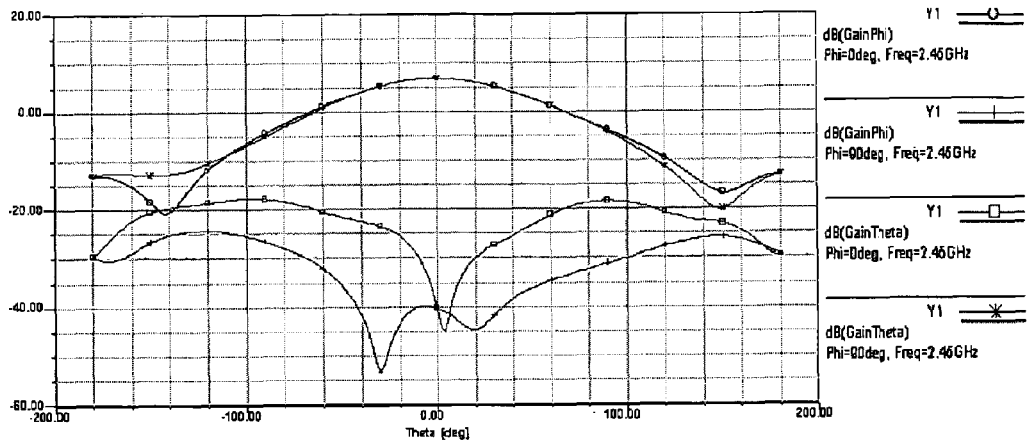
Figure 9D:
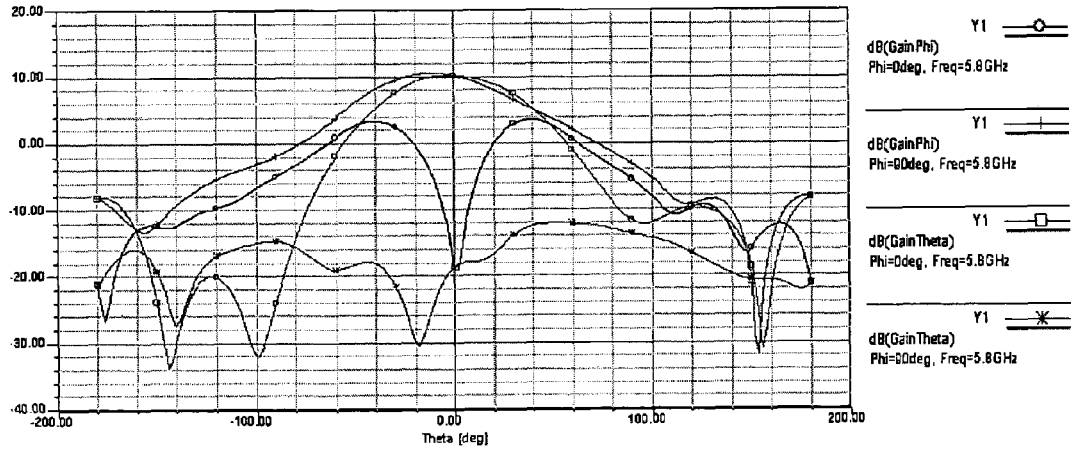

Reference is made to FIG. 8, which shows a graph 100 of return loss versus frequency for the example antenna 10 of FIG. 7. FIGS. 9*a* through 9*d* show graphs of the E-plane and H-plane patterns and cross-polarization of the example embodiment antenna 10 of FIG. 7 at 1.5 GHz, 1.95 GHz, 2.45 GHz, and 5.8-6 GHz, respectively.

Through appropriate placement of the feed pin 18 locations, circular polarization may be obtain in the GPS band by independently feeding either of the feed pins 18*a* or 18*b*. Each feed pin generates a particular direction of rotation (left-hand or right-hand) circular-polarized field.

The dual pin 18 design allows for dynamic tuning of antenna performance. In other words, the dual feed pins 18 provide the ability to achieve adaptive patterns and polarization agility. Adaptive adjustments are achieved by dynamically adjusting amplitude and phase at one of the feed pins 18*a* or 18*b* relative to the other feed pin 18*a* or 18*b*. Because the feed pins 18 are independent they need not maintain a predetermined phase relationship—such as is the case in some dual pin designs intended for 90 degree out-of-phase operation. This allows the antenna 10 to react to changing conditions in its environment to optimize performance. This arrangement behaves like a co-located, two element, phased array, offering agile electronic control of the pattern and polarization characteristics of the antenna 10.

Figure 3:
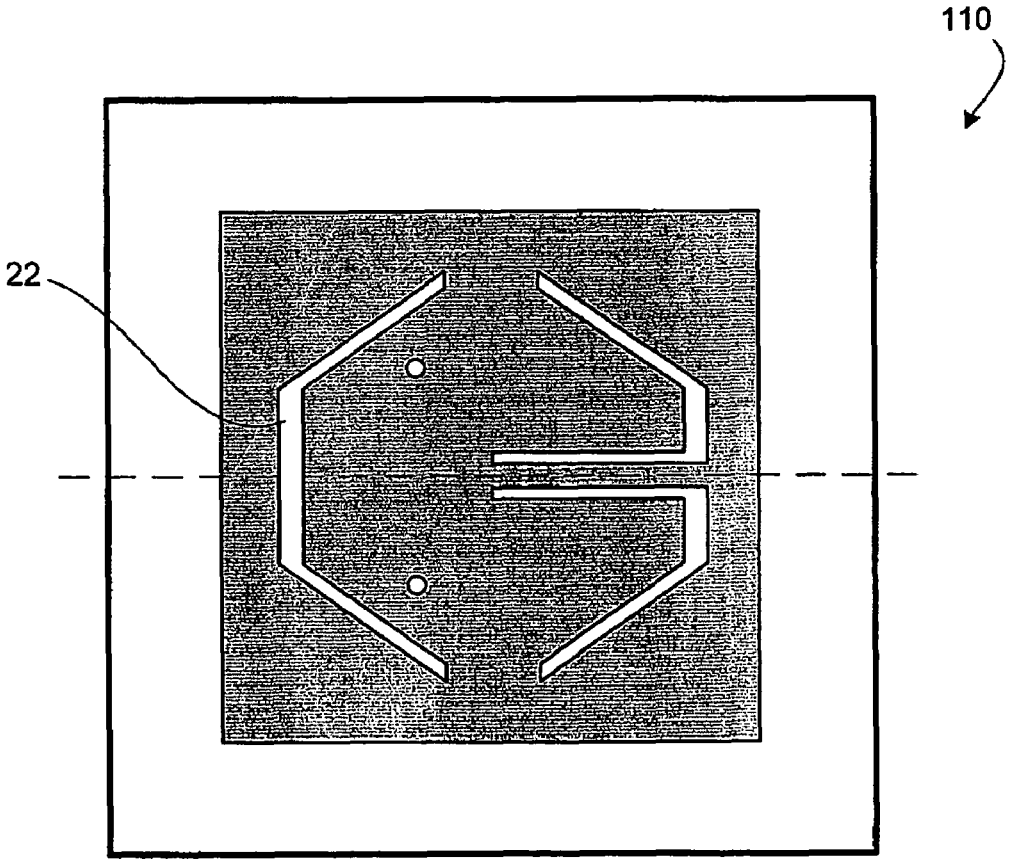
FIG. 3 shows a top plan view of a second embodiment of a multi-band planar antenna.

FIGS. 3 through 6 and 10 to 12 show top plan views of other embodiments of a multi-band planar antenna. FIG. 3 shows an embodiment of an antenna 110 wherein the slots are arranged in a hexagonal perimeter rather than an octagonal perimeter. In particular, the first slot 22 comprises three segments instead of five.

Figure 4:
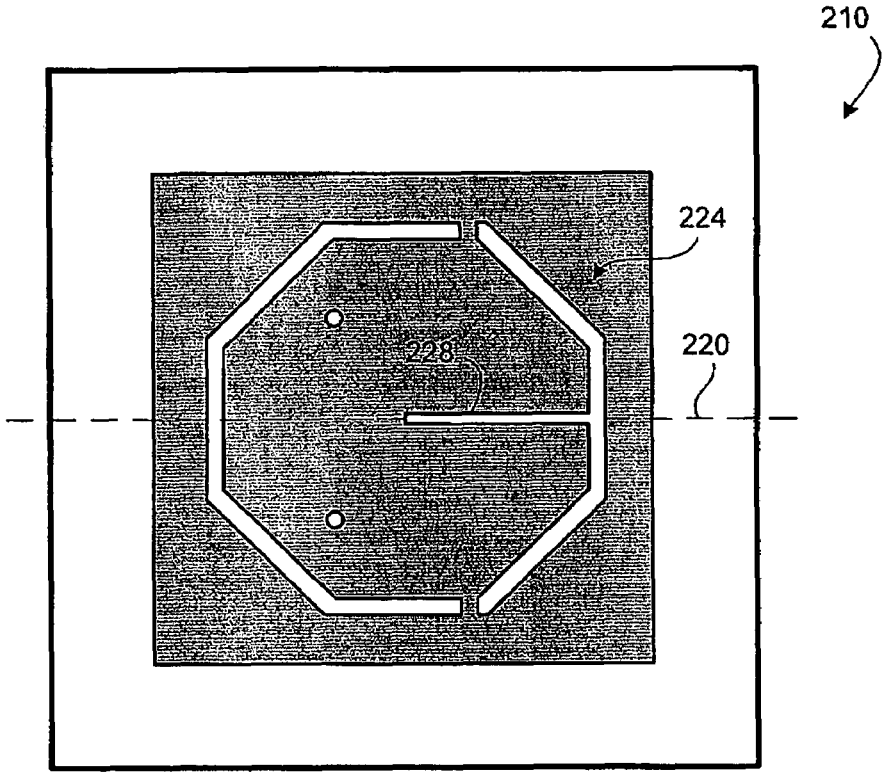
FIG. 4 shows a top plan view of a third embodiment of a multi-band planar antenna.

FIG. 4 shows an embodiment of an antenna 210 wherein, instead of separate second and third slots 22, 24 (FIG. 1), the antenna 210 includes a single upper band slot 224. The upper band slot 224 includes an inwardly projecting arm 228 disposed along a center axis 220.

Figure 5:
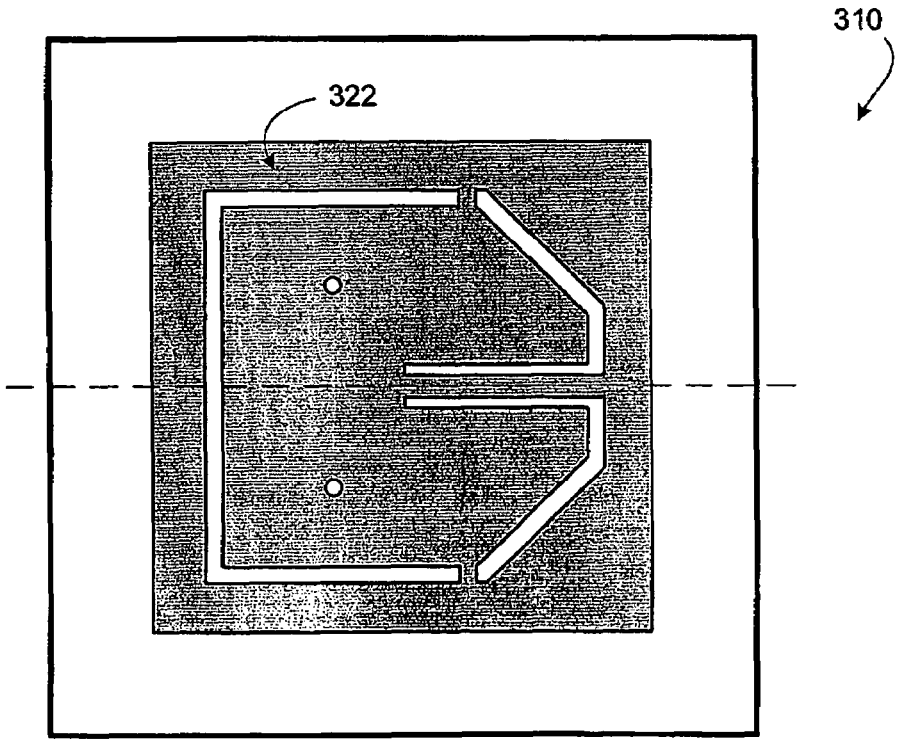
FIG. 5 shows a top plan view of a fourth embodiment of a multi-band planar antenna.
Figure 6:
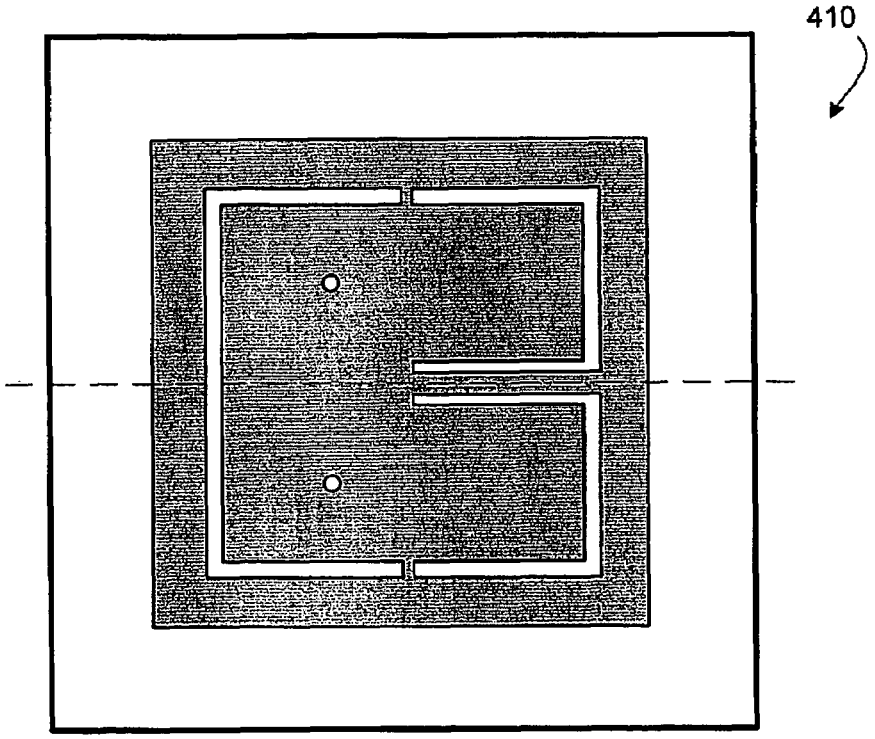
FIG. 6 shows a top plan view of a fifth embodiment of a multi-band planar antenna.

FIG. 5 shows an embodiment of an antenna 310 wherein a first slot 322 comprises a U-shaped slot. FIG. 6 shows an embodiment of an antenna 410 wherein all the slots are U-shaped slots. It will be appreciated that it may not be possible to achieve circular polarization at GPS frequencies when the first slot 22 (FIG. 1) is configured as a U-shaped slot as shown in FIGS. 5 and 6.

Figure 10:
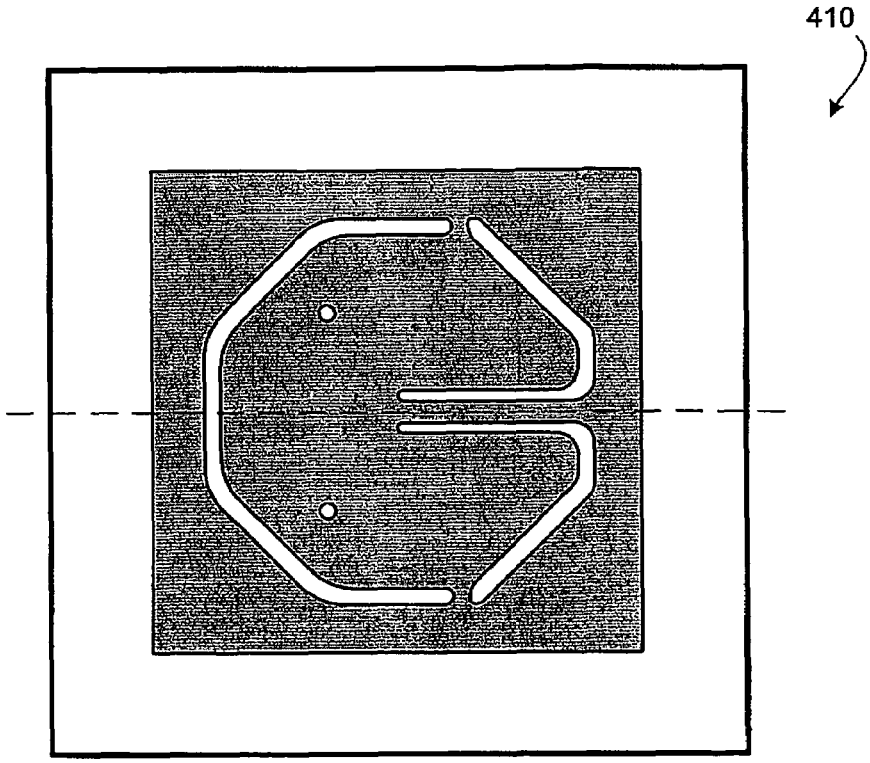
FIG. 10 shows a top plan view of a sixth embodiment of a multi-band planar antenna.

FIG. 10 shows an embodiment of an antenna 410 that is similar to the antenna 10 of FIG. 1, but wherein the folded slots do not feature sharp corners. Instead, the folded slots are formed from straight segments joined at obtuse angles by arcs so as to feature rounded corners.

Figure 11:
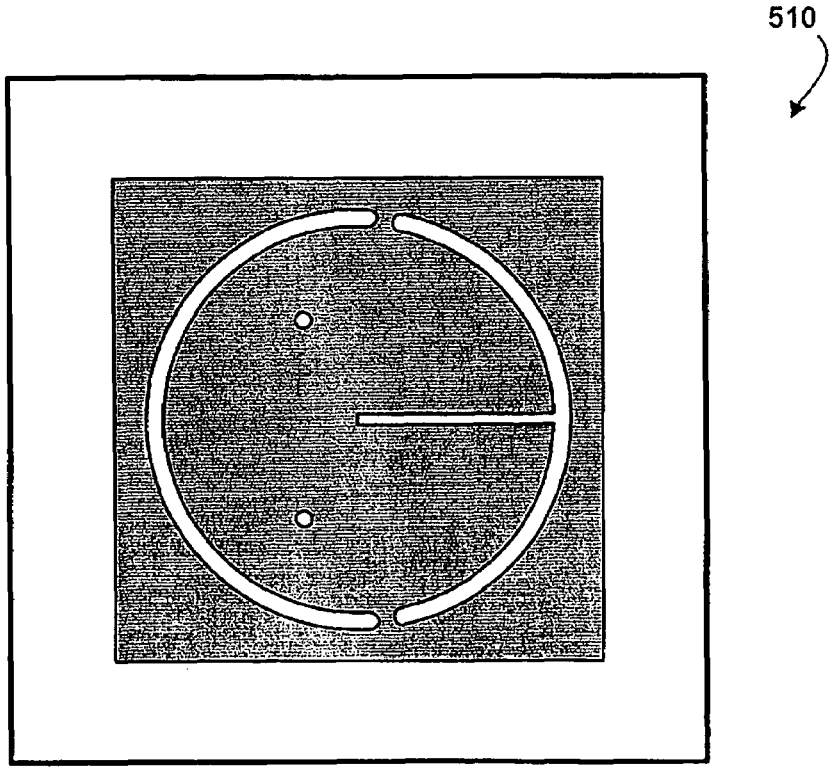
FIG. 11 shows a top plan view of a seventh embodiment of a multi-band planar antenna.
Figure 12:
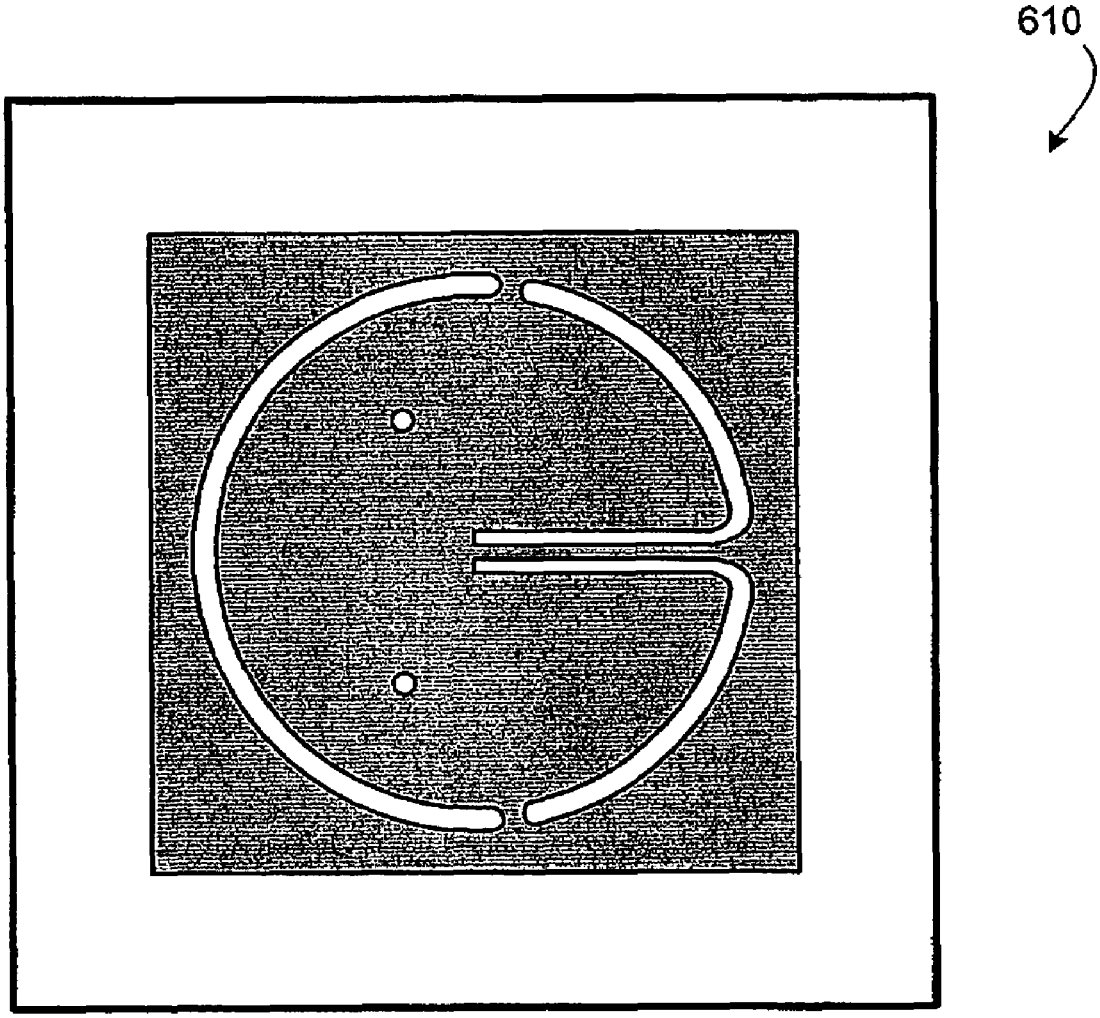
FIG. 12 shows a top plan view of an eighth embodiment of a multi-band planar antenna.

FIGS. 11 and 12 show embodiments of an antenna 510, 610, respectively, wherein the perimeter is formed using curved slots so as to provide for a circular or elliptical geometry.

Other geometric arrangements for the slot pattern will be understood by those of ordinary skill in the art having regard to the description provided herein. The slot pattern is arranged so as to provide a perimeter and at least one inwardly extending slot arm positioned along an axis passing between the dual feed pins. Such a slot pattern gives rise to multiple zones, which allow for the development of multiple modes and the consequent multi-band functionality.

It will be appreciated that although many of the foregoing described embodiments feature dual feed pins spaced symmetrically about a center axis, the feed pins need not be placed symmetrically. Non-symmetrical placement of the feed pins may give rise to unique and desirable antenna patterns. In some embodiments, only a single feed pin may be required to achieve the characteristics required for a particular application.

The present invention may be embodied in other specific forms without departing from the spirit or essential characteristics thereof. Certain adaptations and modifications of the invention will be obvious to those skilled in the art. Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A multi-band antenna comprising:

a planar conductive patch;

a ground plane parallel to and spaced apart from the planar conductive patch;

a dielectric substrate disposed between the planar conductive patch and the ground plane; and at least two feed pins connected to the planar conductive patch through the dielectric substrate, each of said feed pins being electrically isolated from the ground plane, wherein the planar conductive patch includes a slot pattern comprising two or more folded slots, said slot pattern defining a perimeter substantially surrounding said at least two feed pins and being symmetrical about a center axis.

2. The multi-band antenna claimed in claim 1, wherein said slot pattern includes at least one slot extending inwards from said perimeter, said at least one slot being disposed along an axis, wherein said axis passes between said at least two feed pins.

3. The multi-band antenna claimed in claim 2, wherein said axis is parallel to said center axis.

4. The multi-band antenna claimed in claim 1, wherein said at least two feed pins are disposed symmetrically about said center axis.

5. The multi-band antenna claimed in claim 1, wherein said folded slots include a wideband slot, said center axis bisecting said wideband slot, and at least one upperband slot, said upperband slot including at least one inwardly extending segment disposed parallel to said center axis and dividing said antenna into multiple zones.

6. The multi-band antenna claimed in claim 5, wherein said at least one upperband slot includes a pair of v-shaped slots arranged on either side of the center axis, each of said v-shaped slots including three segments and wherein one of said three segments comprises an inwardly extending arm disposed parallel to said center axis.

7. The multi-band antenna claimed in claim 5, wherein said wideband slot includes five segments joined at obtuse angles.

8. The multi-band antenna claimed in claim 7, wherein said perimeter comprises an octagonal perimeter.

9. The multi-band antenna claimed in claim 1, wherein each folded slot includes at least two straight segments joined at an obtuse angle.

10. The multi-band antenna claimed in claim 1, wherein at least one folded slot comprises two straight segments joined by an arc.

11. The multi-band antenna claimed in claim 1, wherein, in one mode, at least one of said folded slots provides circular polarization in combination with at least one of said feed pins, and wherein said folded slots and said feed pins provide at least three other modes.

12. The multi-band antenna claimed in claim 1, wherein said slot pattern includes at least one curved slot.

13. A multi-band antenna comprising:

a planar conductive patch;

a ground plane parallel to and spaced apart from the planar conductive patch;

a dielectric substrate disposed between the planar conductive patch and the ground plane; and at least two feed pins connected to the planar conductive patch through the dielectric substrate, each of said feed pins being electrically isolated from the ground plane, wherein the planar conductive patch includes a slot pattern, said slot pattern defining a perimeter substantially surrounding said at least two feed pins and being symmetrical about a center axis, said slot pattern includes a first slot bisected by said center axis and a second slot and a third slot arranged on opposite sides of said center axis, and wherein said inwardly extending arm includes a first inwardly extending arm and a second inwardly extending arm, said first inwardly extending arm forming part of said second slot and said second inwardly extending arm forming part of said third slot, and wherein said first inwardly extending arm and said second inwardly extending arm are disposed parallel to each other, said perimeter defines an inner antenna area and wherein said inwardly extending arm divides said inner antenna area into at least three zones and said slot pattern including an inwardly extending arm projecting inwards from said perimeter.

14. The multi-band antenna claimed in claim 13, wherein said second slot further includes two perimeter segments joined at an obtuse angle and wherein said first inwardly extending arm joins at least one of said two perimeter segments at a right angle, and wherein said third slot comprises a mirror image of said second slot across said center axis.

15. The multi-band antenna claimed in claim 13, wherein said perimeter defined by said slot pattern defines a central area of the planar conductive patch, and wherein said central area includes at least six straight sides joined at obtuse angles.

16. A multi-band antenna comprising:

a planar conductive patch;

a ground plane parallel to and spaced apart from the planar conductive patch;

a dielectric substrate disposed between the planar conductive patch and the ground plane; and two feed pins connected to the planar conductive patch through the dielectric substrate, wherein the planar conductive patch defines at least two folded slots, said folded slots each comprising at least three straight segments joined at angles, said folded slots being arranged to define a perimeter substantially surrounding said at least two feed pins and being disposed symmetrically about a center axis passing between said two feed pins, and at least one of said folded slots including an inwardly extending arm projecting inwards from said perimeter.

17. The multi-band antenna claimed in claim 16, wherein said inwardly extending arm is disposed along a second axis parallel to said center axis, wherein said second axis passes between said two feed pins.

18. The multi-band antenna claimed in claim 17, wherein said at least two folded slots comprises a first slot having at least five segments joined at obtuse angles and positioned along said perimeter symmetrically about said center axis, and a second slot and a third slot, wherein said second slot and said third slot mirror each other across said center axis, and wherein said second slot includes a first inwardly extending arm and said third slot includes a second inwardly extending arm, said first inwardly extending arm and said second inwardly extending arm being parallel to each other.

19. The multi-band antenna claimed in claim 18, wherein said second slot and said third slot further include two straight segments joined at an obtuse angle and arranged along said perimeter.

20. The multi-band antenna claimed in claim 19, wherein said second slot and said third slot comprise truncated v-shaped slots.

* * * * *